US007241957B1

(12) United States Patent
Lin

(10) Patent No.: US 7,241,957 B1
(45) Date of Patent: Jul. 10, 2007

(54) TWO-IN-ONE BUTTON STRUCTURE

(75) Inventor: Tzu-Chih Lin, Hsinchu (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/600,050

(22) Filed: Nov. 16, 2006

(51) Int. Cl.
*H01H 13/78* (2006.01)

(52) U.S. Cl. ..... 200/16 A; 200/530

(58) Field of Classification Search ..... 200/5 A, 200/16 R–16 D, 18, 520, 530, 534, 535, 200/341
See application file for complete search history.

(56) References Cited

U.S. PATENT DOCUMENTS 4,055,736 A * 10/1977 Congelliere ..... 200/16 A
4,343,973 A * 8/1982 Main ..... 200/516
4,924,046 A * 5/1990 Howard ..... 200/516
5,345,051 A * 9/1994 Miike ..... 200/345
5,898,147 A * 4/1999 Domzalski et al. ..... 200/1 B
6,222,144 B1 * 4/2001 Nishikawa ..... 200/537
6,809,272 B2 * 10/2004 Yamada ..... 200/1 B
6,838,630 B2 * 1/2005 Sasaki ..... 200/553

* cited by examiner

*Primary Examiner*—Michael A Friedhofer
(74) *Attorney, Agent, or Firm*—Rosenberg, Klein & Lee

(57) ABSTRACT

A two-in-one button structure includes a casing, a grounded plate, two signal plates, and two button bodies. The casing has two containing spaces and a plurality of guiding grooves respectively communicating with the two containing spaces. The grounded plate is contained in the two containing spaces. The two signal plates are separated from the grounded plate and are contained in the two containing spaces, respectively. The two button bodies are covering the two containing spaces, respectively. Each button body has a conductive element disposed on a bottom side thereof for allowing a conductive state to form between the grounded plate and a corresponding one of the two signal plates. Therefore, when one of the two button bodies is pressed, the grounded plate and the corresponding one of the two signal plates become conductive via the conductive element.

6 Claims, 4 Drawing Sheets

TWO-IN-ONE BUTTON STRUCTURE

BACKGROUND OF THE INVENTION

1. Field of the Invention

The present invention relates to a button structure, and particularly relates to a two-in-one button structure.

2. Description of the Related Art

There are many methods for people to commemorate an occasion. One common way is by taking pictures, because any occasion such as travel, a celebration, an event, or any good time that deserves to be commemorated can be recorded via a camera. Moreover, it is convenient for users to transmit image data from a camera to an electronic device such as a computer for modifying the image data. In addition, the price of a digital camera has become increasingly cheaper, so the amount of users increases day by day.

However, digital cameras tend to be light and portable, so that design space for digital cameras tends to be restricted. Hence, it is important for designers to assemble a button structure in the limited space of a small-sized PCB. For example, the known button structure is a single button that occupies a large amount of the available space on a PCB, and the known button structure requires more time for the SMT (Surface Mount Technology) process so that it increases costs.

SUMMARY OF THE INVENTION

The present invention provides a two-in-one button structure. In the present invention two button bodies are combined together in the same button structure so that not only the space taken up on the PCB is decreased, but also the spend time required for the SMT process is lowered. Hence, the two-in-one button structure of the present invention is superior to that of the single button structure of the prior art.

One aspect of the present invention is a two-in-one button structure, comprising: a casing, at least one grounded plate, at least two signal plates, and at least two button bodies.

The casing has at least two containing spaces and a plurality of guiding grooves respectively communicating with the two containing spaces. The grounded plate is contained in the two containing spaces, and the grounded plate has two ground guiding pins respectively protruded outwardly from the two corresponding guiding grooves. The two signal plates are separate from the grounded plate and are respectively contained in the two containing spaces. Each signal plate has a signal guiding pin outwardly protruded from the one corresponding guiding groove. The two button bodies respectively cover the two containing spaces, and each button body has a conductive element disposed on a bottom side thereof for allowing a conductive state to form between the grounded plate and a corresponding one of the two signal plates. Therefore, when one of the two button bodies is pressed, the grounded plate and the corresponding one of the two signal plates become conductive via the conductive element.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF PREFERRED BEST MOLDS

Figure 1:
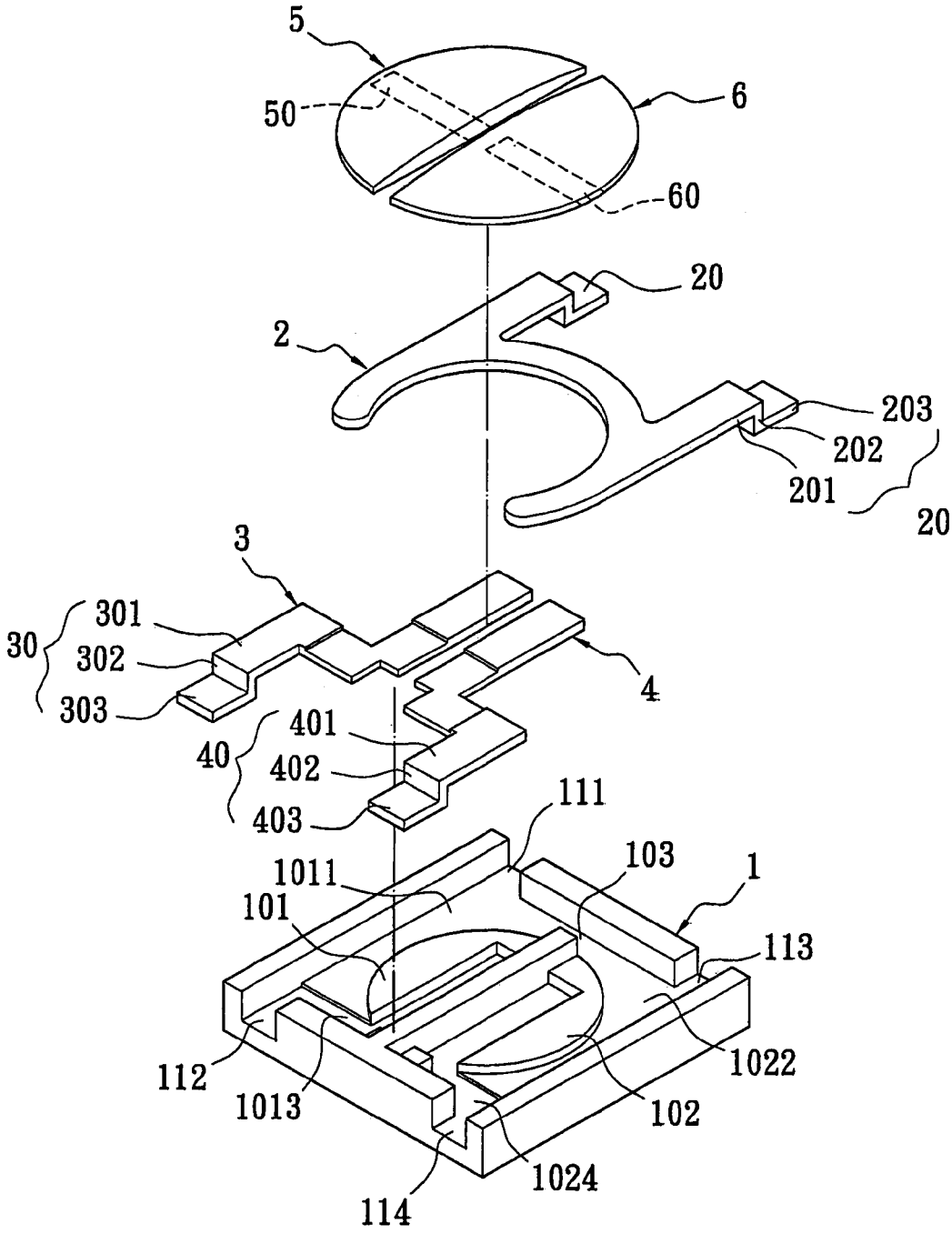
FIG. 1 is a perspective, exposed view of a two-in-one button structure according to the present invention.
Figure 2:
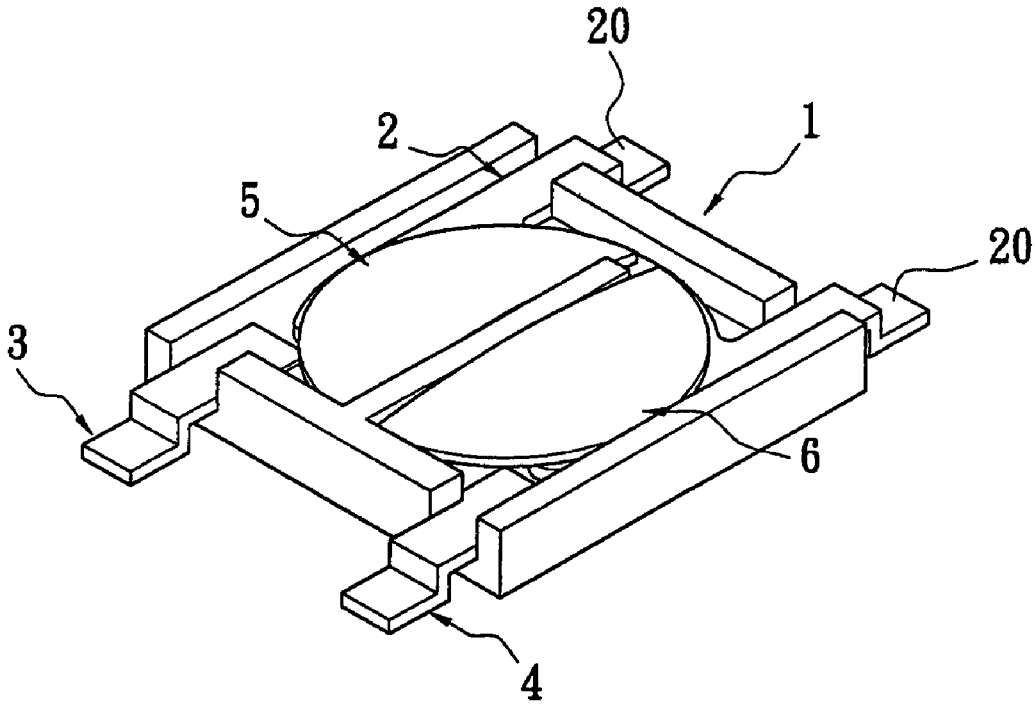
FIG. 2 is a perspective, assembled view of a two-in-one button structure according to the present invention.
Figure 3:
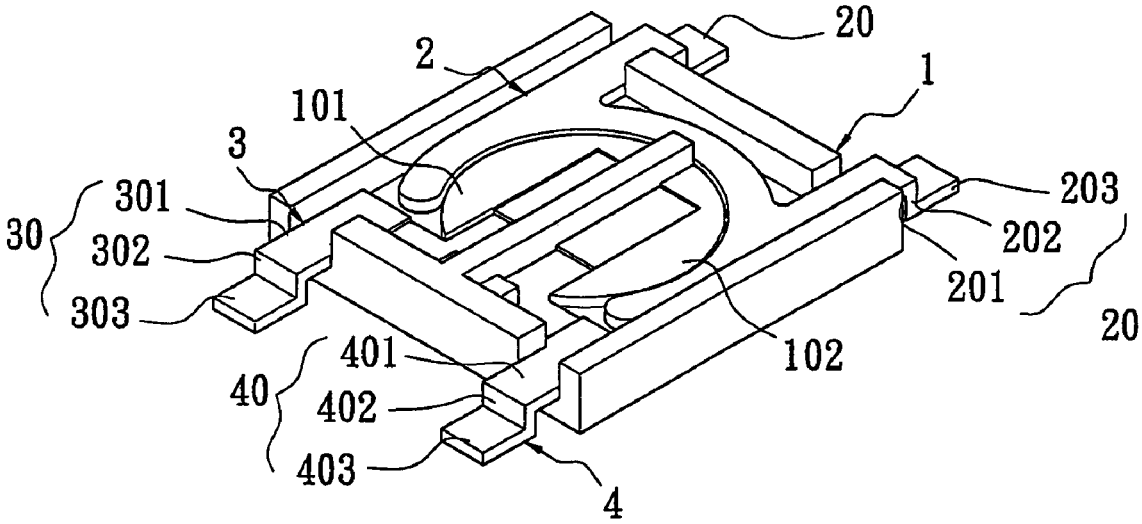
FIG. 3 is a perspective, assembled view of a two-in-one button structure lacking the two button bodies according to the present invention.
Figure 4:
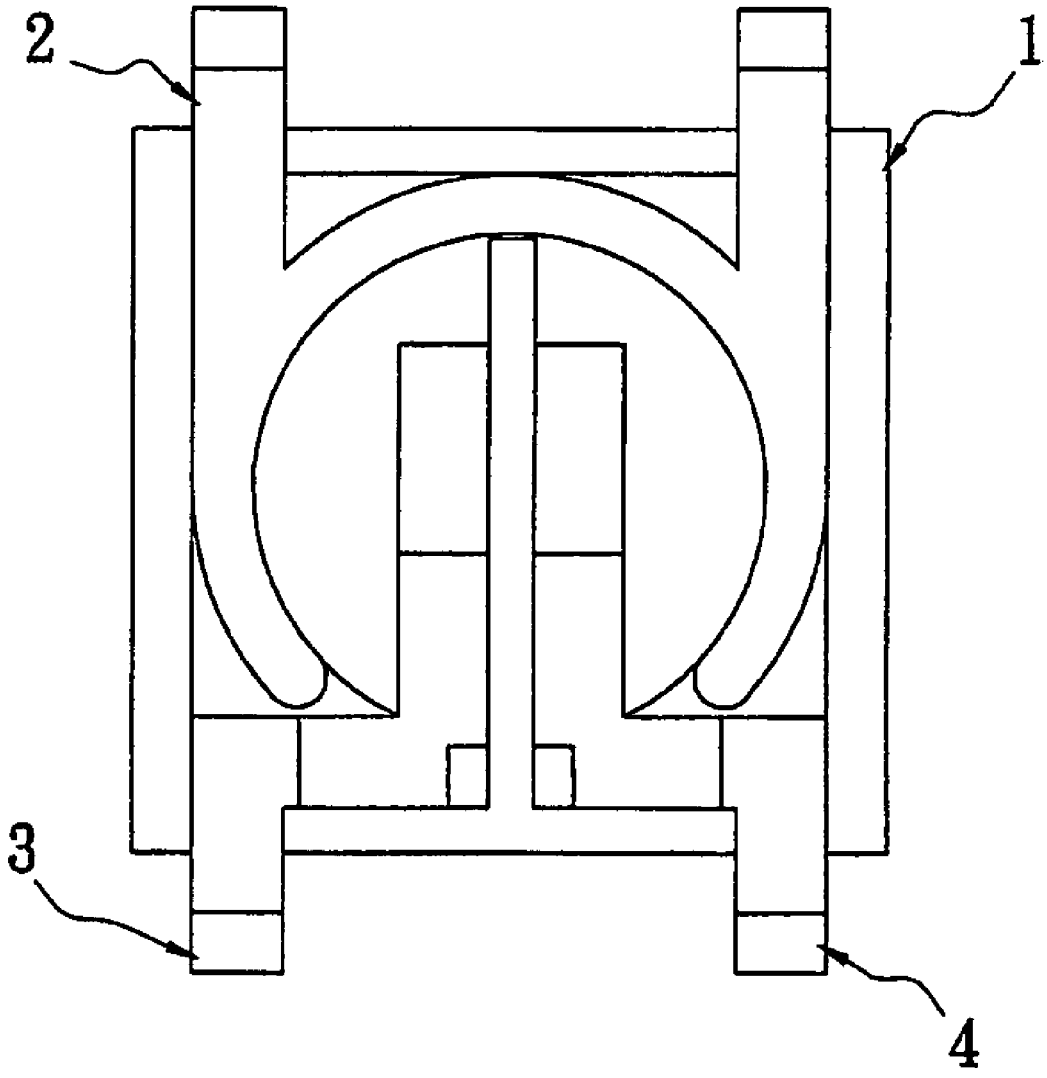
FIG. 4 is a top view of a two-in-one button structure lacking two button bodies according to the present invention.

Referring to FIGS. 1 to 4, the present invention provides a two-in-one button structure, comprising: a casing 1, a grounded plate 2, a first signal plate 3, a second signal plate 4, a first button body 5, and a second button body 6.

The casing 1 has a first containing space 101 and a second containing space 102, a communication groove 103, a first guiding groove 111, a second guiding groove 112, a third guiding groove 113, and a fourth guiding groove 114.

The communication groove 103 is used to communicate the first containing space 101 and the second containing space 102. The first guiding groove 111 and the second guiding groove 112 are formed on two opposite sides of the first containing space 101, respectively. The third guiding groove 113 and the fourth guiding groove 114 are formed on two opposite sides of the second containing space 102. In addition, the first guiding groove 111 and the third guiding groove 113 are formed on one side of the casing 1, and the second guiding groove 112 and the fourth guiding groove 114 are formed on an opposite side of the casing 1.

The grounded plate 2 is contained in a first concave groove 1011 of the first containing space 101 and a second concave groove 1022 of the second containing space 102 by a way of traversing the communication groove 103. The grounded plate 2 has two ground guiding pins 20 respectively outwardly protruded from the first guiding groove 111 of the first containing space 101 and the third guiding groove 113 of the second containing space 102. Moreover, each ground guiding pin 20 has an extending portion 201, a bending portion 202 downwardly bent from the extending portion 201, and a protruding portion 203 outwardly protruded from the bending portion 202.

The first signal plate 3 separates from the grounded plate 2 and is contained in a third concave groove 1013 of the first containing space 101. The first signal plate 3 has a first signal guiding pin 30 outwardly protruded from the second guiding groove 112 of the first containing space 101. Furthermore, the first signal guiding pin 30 has an extending portion 301, a bending portion 302 downwardly bent from the extending portion 301, and a protruding portion 303 outwardly protruded from the bending portion 302.

The second signal plate 4 separates from the grounded plate 2 and is contained in a fourth concave groove 1024 of the second containing space 102. The second signal plate 4 has a second signal guiding pin 40 outwardly protruded from the fourth guiding groove 114 of the second containing space 102. Furthermore, the second signal guiding pin 40 has an extending portion 401, a bending portion 402 downwardly bent from the extending portion 401, and a protruding portion 403 outwardly protruded from the bending portion 402.

The first button body 5 covers the first containing space 101, and the first button body 5 has a first conductive element 50 disposed on a bottom side thereof for allowing a conductive state to form between the grounded plate 2 and the first signal plate 3. Furthermore, the second button body 6 covers the second containing space 102, and the second button body 6 has a second conductive element 60 disposed on a bottom side thereof for allowing a conductive state to form between the grounded plate 2 and the second signal plate 4.

Therefore, when the first button body 5 is pressed, the grounded plate 2 and the first signal plate 3 become conductive via the first conductive element 50. When the second button body 6 is pressed, the grounded plate 2 and the second signal plate 4 become conductive via the second conductive element 60.

However, the two-in-one button structure should not be used to limit the present invention. Any all-in-one button structure is protected under the claims of the present invention.

In conclusion, the present invention has two button bodies (or more than two button bodies) combined together in the same button structure thereby not only decreasing the space used on a PCB, but also reducing the spend time required for the SMT process. Hence, the two-in-one button structure of the present invention is superior to that of the single button structure of the prior art.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A two-in-one button structure, comprising:

a casing having at least two containing spaces and a plurality of guiding grooves respectively communicated with the at least two containing spaces;

at least one grounded plate contained in the at least two containing spaces, wherein the at least one grounded plate has two grounded guiding pins respectively outwardly protruded from two of the guiding grooves;

at least two signal plates separate from the at least one grounded plate and respectively contained in the at least two containing spaces, wherein each signal plate has a signal guiding pin outwardly protruded from one of the guiding grooves; and at least two button bodies respectively covering the at least two containing spaces, wherein each button body has a conductive element disposed on a bottom side thereof for allowing a conductive state to form between the at least one grounded plate and a corresponding one of the at least two signal plates;

whereby, when one of the at least two button bodies is pressed, the at least one grounded plate and the corresponding one of the at least two signal plates become conductive via the conductive element.

2. The two-stage button structure as claimed in claim 1, wherein the casing has a communication groove for communicating with the at least two containing spaces.

3. The two-stage button structure as claimed in claim 2, wherein the at least one grounded plate is contained in the at least two containing spaces by a way of traversing the communication groove.

4. The two-stage button structure as claimed in claim 1, wherein two of the guiding grooves are formed on one side of the casing, and the other guiding grooves are formed on an opposite side of the casing.

5. The two-stage button structure as claimed in claim 1, wherein each ground guiding pin has an extending portion, a bending portion downwardly bent from the extending portion, and a protruding portion outwardly protruded from the bending portion.

6. The two-stage button structure as claimed in claim 1, wherein each signal guiding pin has an extending portion, a bending portion downwardly bent from the extending portion, and a protruding portion outwardly protruded from the bending portion.

* * * * *